United States Patent [19]

Saytar

[11] Patent Number: 4,492,380

[45] Date of Patent: Jan. 8, 1985

[54] ARENA TYPE GAME

[76] Inventor: Andrew Saytar, 184 Glenview Dr., Mississauga, Ontario, Canada, L5G 2N6

[21] Appl. No.: 476,914

[22] Filed: Mar. 21, 1983

[51] Int. Cl.[3] ..... A63B 71/02

[52] U.S. Cl. ..... 273/411; 273/181 F; 273/400; 273/1 B; 273/1.5 R

[58] Field of Search ..... 273/411, 1.5 R, 1.5 A, 273/1 B, 354, 398, 400, 401, 402, 399, DIG. 25, 127 R, 181 A, 181 F, 181 K

[56] References Cited

U.S. PATENT DOCUMENTS

| | | | |
|---|---|---|---|
| 920,907 | 5/1909 | Bolton | 273/181 F |
| 2,805,070 | 9/1957 | Waters | 273/181 F |
| 2,873,969 | 2/1959 | Ziel | 273/402 X |
| 3,580,578 | 5/1971 | McCarthy | 273/401 X |
| 3,810,618 | 5/1974 | Nedwick | 273/401 X |
| 3,887,181 | 6/1975 | Samaras | 273/1 B |
| 3,923,304 | 12/1975 | Warren | 273/398 |
| 3,944,223 | 3/1976 | Bromwell | 273/1 B |
| 4,148,555 | 4/1979 | Lerman | 273/387 X |
| 4,260,154 | 4/1981 | Balbastro | 273/411 |
| 4,323,250 | 4/1982 | Lansberry | 273/411 X |

*Primary Examiner*—William H. Grieb

*Attorney, Agent, or Firm*—Donald E. Hewson

[57] ABSTRACT

A game apparatus can be used for both hockey and basketball when the method of play of both those games is modified slightly. Both games can then be played inexpensively and without special exclusive skills, yet without losing their basic exciting character. A goal assembly comprises a net with target holes, and pockets for retaining scores, scoring in both games being effected by shooting the ball through a hole. In the hockey modification, no goalkeeper is needed. In the basketball modification, physical height is of no particular advantage.

1 Claim, 4 Drawing Figures

ARENA TYPE GAME

BACKGROUND OF THE INVENTION

This invention concerns arena-type games, and the equipment therefor.

Two of the most popular arena games are basketball and hockey. Both of these games can be awkward for casual players to play: in hockey, the safety equipment is very expensive while in basketball the skill needed to score points is very exclusive, and so latent even in those who have it that the skill can only be brought out by a good deal of practice, and the skill is readily lost unless the practice is kept up. Also in basketball, lack of physical height cuts many people off from even trying the game.

When played at high level, of course, both games are exciting and very popular with players and spectators. But neither game, for the different reasons as stated, is suitable to be played occasionally by casual amateurs.

The invnetion is aimed at making it possible for both of the two games to be played and retain their essential exciting character, but with a minimum of special exclusive skill, and with a minimum of expensive equipment. It is recognized in the invention that if the method or rules of play of both the games are modified to a certain extent, then both the games can be played using basically the same very simple apparatus.

In hockey, it is the fast-moving, hard puck that creates the need for the expensive safety equipment. However, the puck has to travel fast if it is to be possible to beat the goalkeeper and score goals. In the invention, it is recognized that by eliminating the goalkeeper in hockey the game can be played with a puck or ball having a much softer and less dangerous consistency than a normal hockey puck; and by providing small targets to aim at rather than a large goal area the requirement for shooting skill is maintained, but the fact that the puck or ball can be softer means that no protective clothing and equipment need be worn by the players.

In basketball, the skill in scoring lies in the ability to overcome the difficulty of throwing the ball through a hoop that is out of reach over the player's head. The provision of small targets for the players to aim at can again be used to provide the necessary scoring difficulty, without the need for the players to be tall, and by demanding only an ordinary throwing skill rather than the special skill required in normal basketball.

Futhermore, it is an aim of the invention to make the two games accessible to children and other beginners, and to allow them to be played in places not dedicated as hockey or basketball arenas, such as school gymnasiums, auditoriums, playgrounds, and church halls.

The invention lies in the provision of a goal assembly at each end of a playing area, each goal comprising at least one target in the form of a delineated hole through which the ball can pass, and further comprising a pocket disposed behind the hole for receiving and containing the ball. The invention includes modifications to the rules of hockey and basketball to the effect that goals are scored by the ball passing through the holes and into the pockets.

As to the prior art, U.S. Pat. No. 3,887,181 (Samaras, June 3, 1975) shows a hockey target having holes with puck-receiving pockets. U.S. Pat. No. 3,944,223 (Bromwell, Mar. 16, 1976) shows holes without pockets. However, neither patent contains the suggestion that a modification to the rules of both hockey and basketball would make it possible for both games to be played using the same simple apparatus. U.S. Pat. No. 4,260,154 (Balbastro, Apr. 7, 1981) describes a game which might be described as "foot-basketball" but the patent again contains no suggestion of the modification to the rules of both hockey and basketball that is called for in the invention. It is also known in the art to provide targets and pockets, but these have mainly been aimed at developing and improving throwing and shooting skills, and for distinguishing hits and misses, in various games. U.S. Pat. No. 4,148,555 (Lerman, Apr. 10, 1979) for example shows such a device for use in basketball.

The invention has the benefit of making it possible for both the games to be available to and played by all, and almost anyone can make a contribution to the play after a short familiarization period, but nevertheless as in all the best games there is an infinite capacity for skill, and for skill improvement, within that basic simplicity.

BRIEF DESCRIPTION OF THE DRAWINGS

Further aspects of the invention will become apparent from the description of any exemplary embodiment, which now follows.

DESCRIPTION OF THE PREFERRED EMBODIMENT

Figure 1:
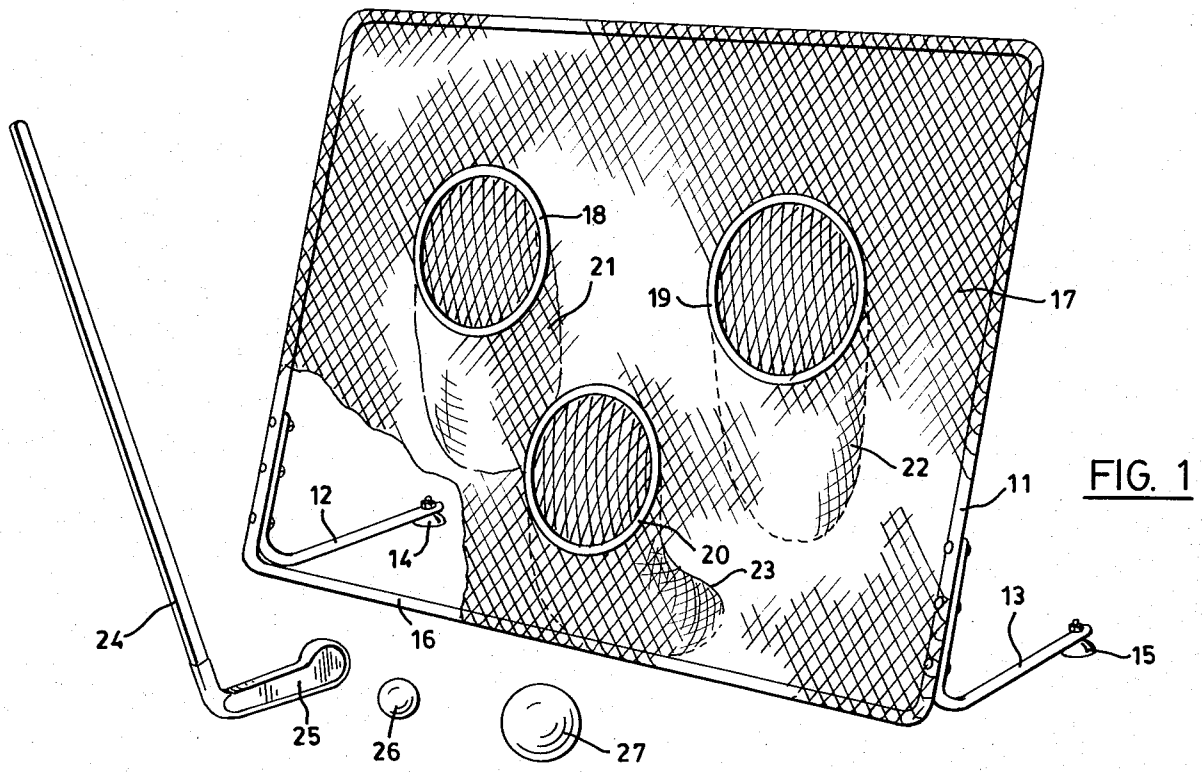
FIG. 1 shows equipment that is suitable for use in the invention.

In FIG. 1, a rectangular frame 11 is formed of aluminum or galvanized steel tubing one inch in diameter, and swaged to permit the joints to be neat and unobtrusive. Supporting legs 12, 13 are also of tubing and are attached by bolts to the frame 11. The legs 12, 13 are bent so as to support the frame 11 at an angle of 15 degrees to the vertical, to keep the frame stable and prevent its toppling over. The legs 12, 13 are provided each with a respective suction pad 14, 15 to hold the frame 11 firmly on, or adjacent to, the playing area. The frame 11 is 56 inches long and 42 inches high, and the bottom portion 16 rests against the surface of the playing area.

Stretched over the frame 11 is a net 17. Three holes are formed in the net 17, the holes being delineated each by a respective 12 inch diameter plastic ring 18, 19, 20. The rings 18, 19 are disposed with their centres 16 inches from the top of the net 17, and 18 inches apart. The ring 20 has its centre 11 inches from the bottom of the net 17.

The material of the net 17 is woven or knitted around the rings 18, 19, 20. Also woven or knitted around the rings 18, 19, 20 are respective pockets 21, 22, 23 and formed of the same material as the net 17. The pockets 21, 22, 23 hang downwardly from the rings 18, 19, 20 behind the net 17. Together the frame 11, the legs 12, 13, the net 17, and the pockets 21, 22, 23 are an example of a goal assembly according to the invention. The net 17 is stretched taut over the frame 11 so that if a ball strikes the net without entering a pocket, the ball will bounce back into the playing area.

The equipment in the exemplary embodiment comprises also a set of sticks, one for each player, one stick 24 being illustrated. The stick 24 is very like a normal hockey stick, except that the blade is a plastic moulding 25 shaped and adapted to be used with a ball 26 rather than a conventional puck. The ball 26 is 3 inches in diameter, and is a hollow plastic sphere having the consistency that it substantially does not bounce when dropped on the surface of the playing area, just as a hockey puck substantially does not bounce on ice.

The equipment in the exemplary embodiment includes also another ball 27. The ball 27 is intended for use with the modified basketball game called for in the invention, and is just like a regular basketball-ball, except that it is rather smaller at 6 inches diameter. The ball 27 is of a consistency that it substantially does bounce of the surface of the playing area, to an extent that dribbling the ball by bouncing it in the characteristic basketball manner is possible.

Figure 2A:
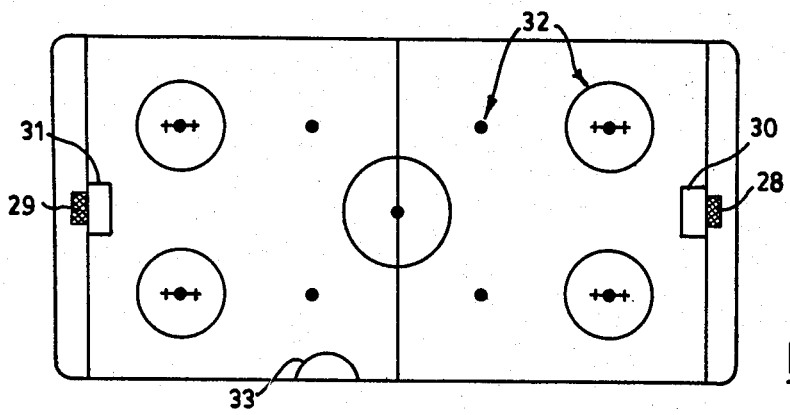
FIG. 2A showing the area marked for hockey modified according to the invention, and FIG. 2B showing the area marked for basketball modified according to the invention.

FIG. 2*a* is a plan of a playing area marked out for the modified hockey game called for in the invention. Goal assemblies 28, 29 are placed one each end of the area. A respective goal crease, 8 feet by 4 feet, 30, 31 is marked in front of each goal assembly 28, 29. Face-off spots 32 are positioned as shown. A referee's crease 33 has been provided.

Figure 2B:
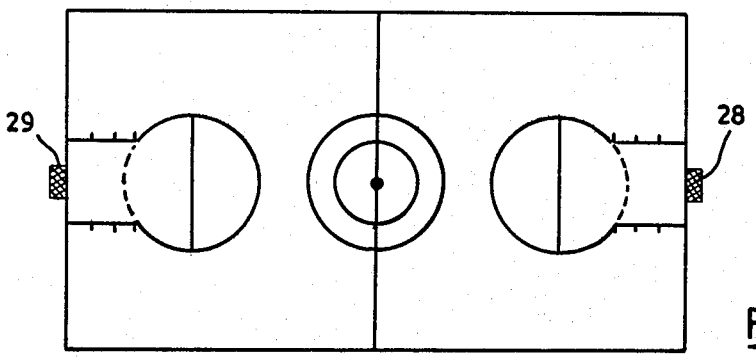
FIG. 2 shows how a playing area may be marked.

FIG. 2B is a plan of the area marked out now for the modified basketball game called for in the invention. Again, goal assemblies 28, 29 are placed one each end of the area. Apart from that, the area is marked in the manner as for conventional basketball.

Figure 3:
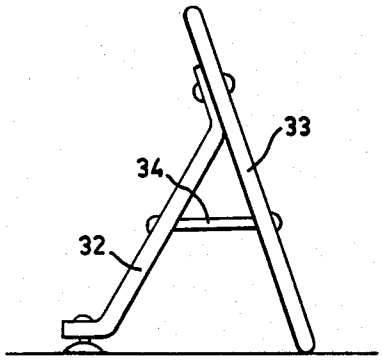
FIG. 3 is a side view of a goal assembly for use with the invention.

FIG. 3 shows an alternative goal assembly to that of FIG. 1, in which the supporting leg 32 is attached higher up the frame 33. A strut 34 lends extra stability. The leg may be bolted to the frame or may be hinged and foldable for ease of portability.

It may be desired to use differently sized holes for the different games, or for different sizes of balls. This possibility can be conveniently accommodated by providing holes of the larger required size and by providing annular masks with openings of the required smaller size, to fit over the holes as necessary.

If the games are to be played competitively, naturally the equipment must be standardized. Where dimensions are quoted in this description they are intended to be the standard dimensions. The equipment should be manufactured to those dimensions unless, within the broadest scope of the invention, the dimensions should become standardized to some other values.

What is claimed is:

1. Game apparatus, suitable for use when playing both a modified hockey game and a modified basketball game, where the apparatus comprises:

two goal assemblies, where a goal assembly comprises:

a net;

a net-supporting frame;

where the net is stretched over the frame and where the net is held by the frame in a substantially upright position;

at least one hole formed in the net;

a rigid ring;

where the ring is secured and attached to the material of the net in such a manner as to delineate the hole;

a pocket, formed of net material;

where the ring is secured and attached to the net material of the pocket in such a manner that the pocket is effectively secured and attached to the net, and is effective to receive and contain a game ball that passes through the ring;

wherein the diameter of said at least one delineating ring is substantially 12 inches;

and the apparatus further comprises two balls;

a first ball for use when playing a modified hockey game, the ball being a sphere having a diameter substantially of 3 inches, and having the characteristic of being not bounce-able on the surface of the playing area, substantially in the manner of a hockey puck on ice;

and a second ball for use when playing a modified basketball game, the ball being a sphere havin a diameter substantially of 6 inches, and having the characteristic of being bounce-able on the surface of the playing area, substantially in the manner of a basketball on a basketball court.

* * * * *